US009747771B1

(12) United States Patent
Martinez

(10) Patent No.: US 9,747,771 B1
(45) Date of Patent: Aug. 29, 2017

(54) TRACKING AND SAFETY SMART WATCH

(71) Applicant: Jacqueline Martinez, Little Elm, TX (US)

(72) Inventor: Jacqueline Martinez, Little Elm, TX (US)

( * ) Notice: Subject to any disclaimer, the term of this patent is extended or adjusted under 35 U.S.C. 154(b) by 0 days.

(21) Appl. No.: 15/284,640

(22) Filed: Oct. 4, 2016

(51) Int. Cl.
*G08B 21/02* (2006.01)

(52) U.S. Cl.
CPC ..... *G08B 21/028* (2013.01); *G08B 21/0208* (2013.01); *G08B 21/0269* (2013.01); *G08B 21/0286* (2013.01); *G08B 21/0288* (2013.01); *G08B 21/0291* (2013.01)

(58) Field of Classification Search
CPC combination set(s) only.
See application file for complete search history.

(56) References Cited

U.S. PATENT DOCUMENTS 5,881,021 A * 3/1999 Pirie ..... B06B 1/0284 340/514
8,059,491 B1 11/2011 Hennings-Kampa
D742,761 S 11/2015 Grazian
2004/0008585 A1* 1/2004 Augspurger ..... G04B 37/1486 368/101
2009/0180355 A1 7/2009 Cartwright
2009/0231960 A1 9/2009 Hutcheson
2012/0050532 A1* 3/2012 Rhyins ..... G01S 5/14 348/143
2012/0313639 A1* 12/2012 Lee ..... G01N 24/08 324/307
2014/0329491 A1 11/2014 Scott
2015/0172893 A1 6/2015 St. Germain et al.
2015/0223705 A1* 8/2015 Sadhu ..... G01S 19/17 600/301
2015/0317810 A1 11/2015 Grunwald et al.

FOREIGN PATENT DOCUMENTS

WO 2008025058 A1 3/2008

* cited by examiner

*Primary Examiner* — Kabir A Timory
(74) *Attorney, Agent, or Firm* — Kyle A. Fletcher, Esq.

(57) ABSTRACT

The tracking and safety smart watch is a signaling device that is worn in the manner of an accessory. The tracking and safety smart watch communicates through messages with an appropriate authority such that security information regarding an individual wearing the tracking and safety smart watch can be monitored. The tracking and safety smart watch allows an appropriate authority can determine the location of the tracking and safety smart watch and to monitor the exterior surroundings of the tracking and safety smart watch. The tracking and safety smart watch provides for the transmission of an emergency message from the individual to the appropriate authority. Safeguards are incorporated into the tracking and safety smart watch to prevent removal of the tracking and safety smart watch from the individual without the approval or the appropriate authority. The tracking and safety smart watch comprises a timepiece, a control system, and a housing.

17 Claims, 6 Drawing Sheets

TRACKING AND SAFETY SMART WATCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of instruments and signaling, calling, and alarm systems, more specifically, an alarm responsive to an undesired or abnormal situation.

SUMMARY OF INVENTION

The tracking and safety smart watch is a signaling device that is worn in the manner of an accessory. The tracking and safety smart watch communicates with an appropriate authority in a dynamic message based manner such that current security information regarding an individual wearing the tracking and safety smart watch can be monitored by and transmitted to the appropriate authority. The tracking and safety smart watch allows an appropriate authority to determine the location of the tracking and safety smart watch and to monitor the exterior surroundings of the tracking and safety smart watch. The tracking and safety smart watch provides for the transmission of an emergency message from the individual to the appropriate authority. Safeguards are incorporated into the tracking and safety smart watch to prevent removal of the tracking and safety smart watch from the individual without the approval of the appropriate authority.

These together with additional objects, features and advantages of the tracking and safety smart watch will be readily apparent to those of ordinary skill in the art upon reading the following detailed description of the presently preferred, but nonetheless illustrative, embodiments when taken in conjunction with the accompanying drawings.

In this respect, before explaining the current embodiments of the tracking and safety smart watch in detail, it is to be understood that the tracking and safety smart watch is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tracking and safety smart watch.

It is therefore important that the claims be regarded as including such equivalent construction insofar as they do not depart from the spirit and scope of the tracking and safety smart watch. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
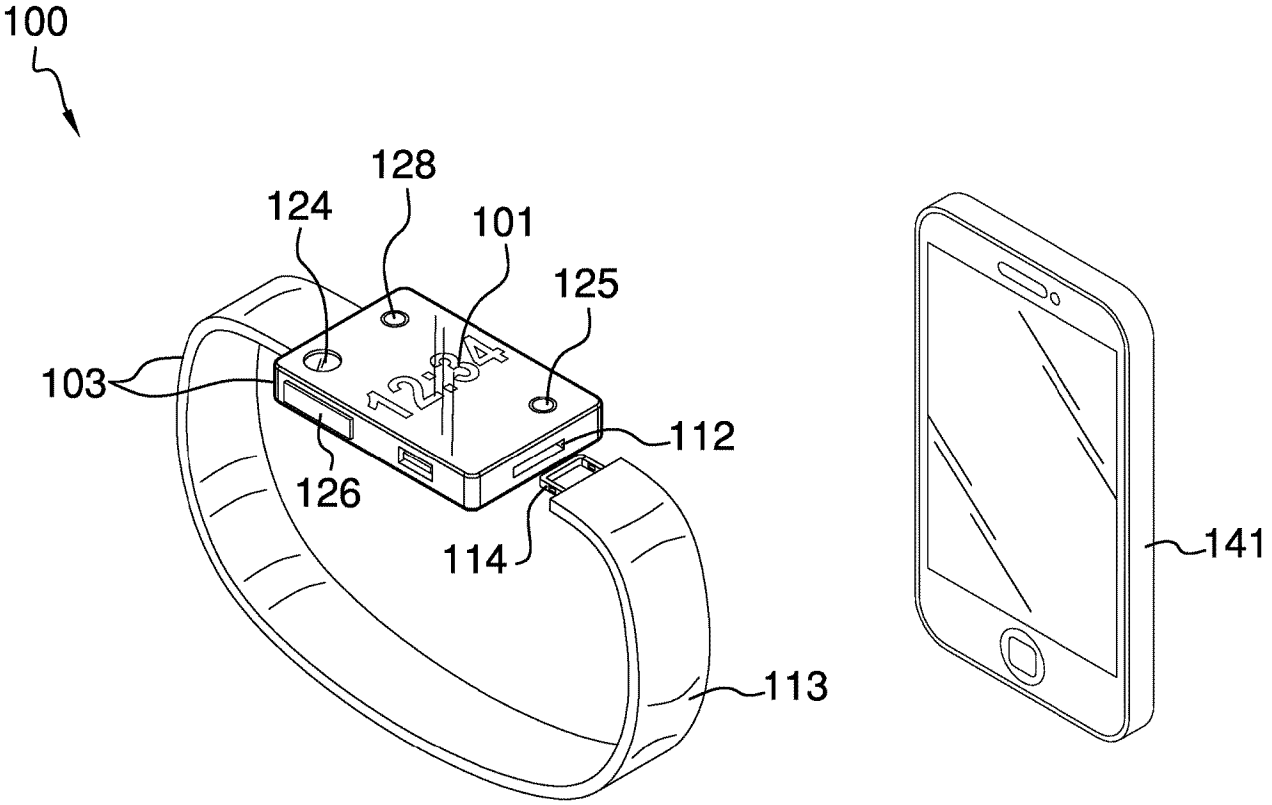
FIG. 1 is a perspective view of an embodiment of the disclosure.
Figure 2:
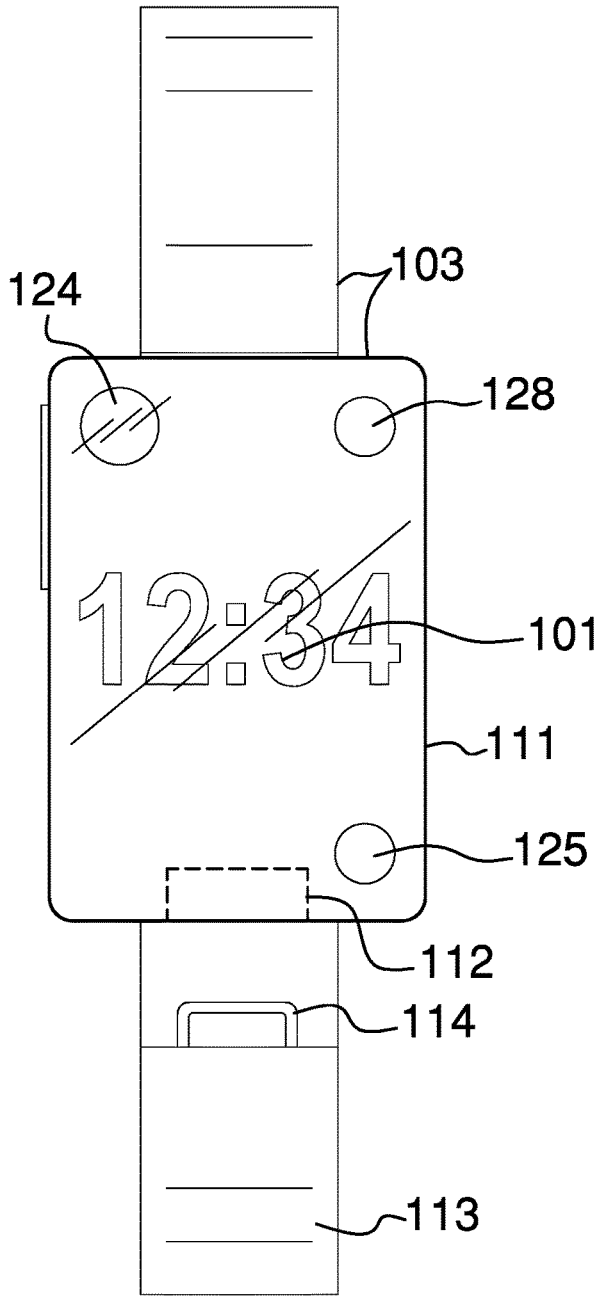
FIG. 2 is a front view of an embodiment of the disclosure.
Figure 3:
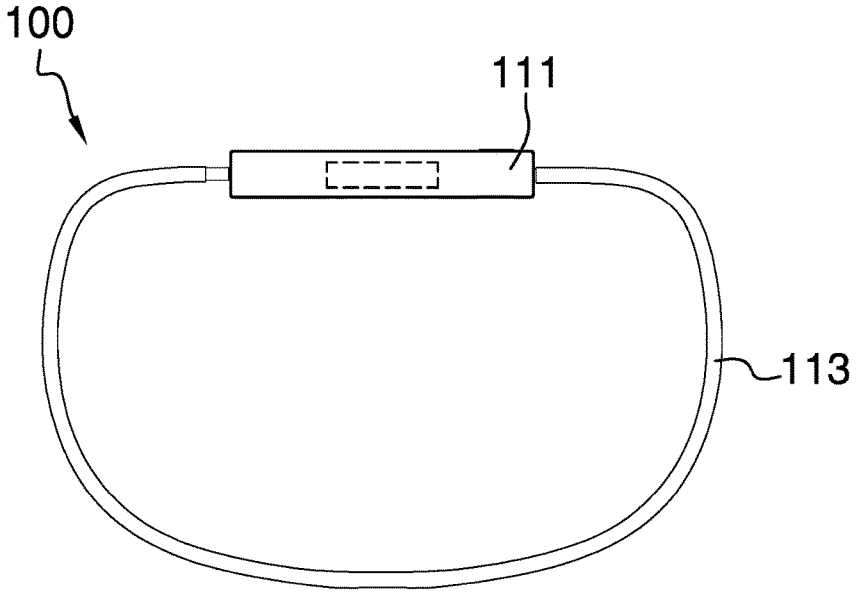
FIG. 3 is a side view of an embodiment of the disclosure.
Figure 4:
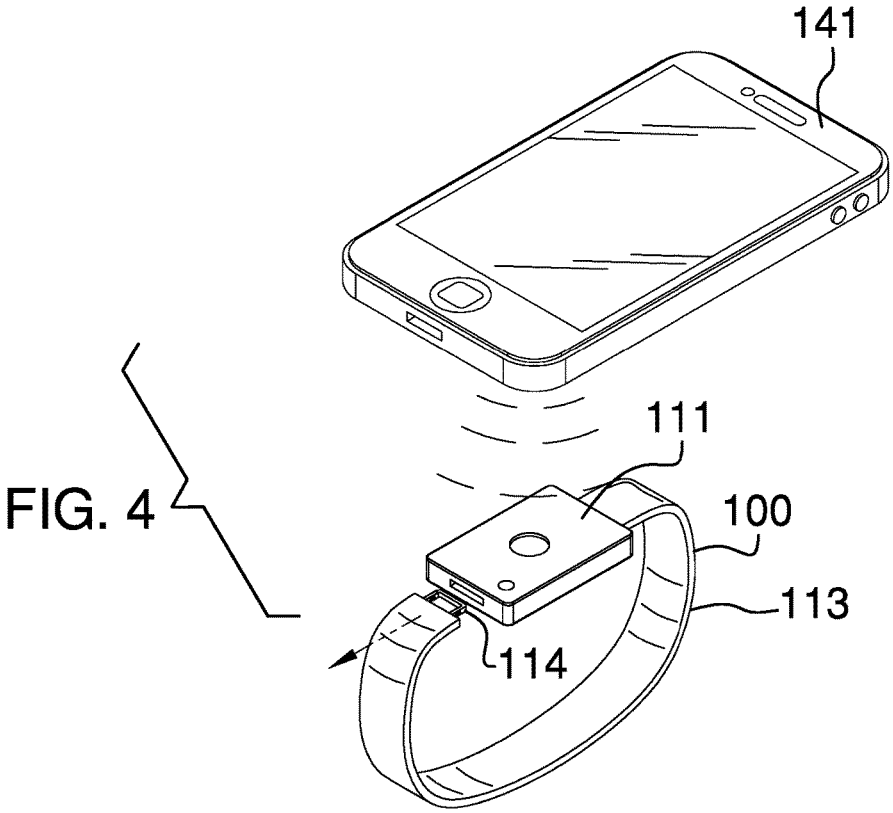
FIG. 4 is an in use view of an embodiment of the disclosure.
Figure 5:
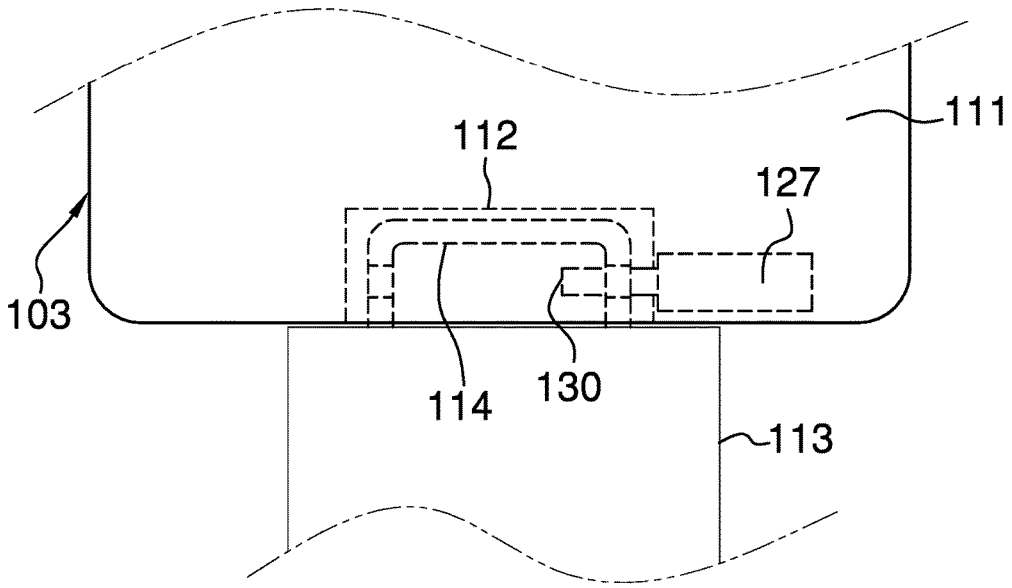
FIG. 5 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The tracking and safety smart watch comprises a timepiece 101, a control system 102, and a housing 103. The timepiece 101 and the control system 102 mount within the housing 103. The housing 103 attaches to an individual. The invention 100 is a signaling device that is worn in the manner of an accessory. The invention 100 communicates with an appropriate authority 141 in a dynamic message based manner such that current security information regarding an individual wearing the invention 100 can be monitored by and transmitted to the appropriate authority 141. The invention 100 allows an appropriate authority 141 can determine the location of the invention 100 and to monitor the exterior surroundings of the invention 100. The invention 100 provides for the transmission of an emergency message from the individual to the appropriate authority 141. Safeguards are incorporated into the invention 100 to prevent removal of the invention 100 from the individual without the approval or the appropriate authority 141.

The timepiece 101 is a readily and commercially available device that indicates the time and date.

The housing 103 comprises a container 111, a latch slot 112, a band 113, and a latch tab 114. The container 111 is formed such that the timepiece 101 is visibly accessible from the exterior of the housing 103. The container 111 is further formed such that a panic button 126 is physically accessible from the exterior of the housing 103. The panic button 126 is discussed in greater detail elsewhere in this disclosure. The band 113 is a strap that is formed into a loop such that the band 113 attaches the housing 103, and by implication the invention 100, to the individual. The band 113 further comprises the latch tab 114, which attaches to an end of the band 113. The latch tab 114 is a U shaped metal structure 115 that has a hole 116 formed in it. The latch slot 112 is an aperture formed in the housing 103. The latch slot 112 is sized to receive the U shaped metal structure 115. The band 113 forms the loop by inserting the U shaped metal structure 115 into the latch slot 112. The locking and unlocking of the U shaped metal structure 115 in the latch slot 112 is discussed elsewhere in this disclosure. Methods to design housings are well known and documented in the mechanical and manufacturing arts.

Figure 6:
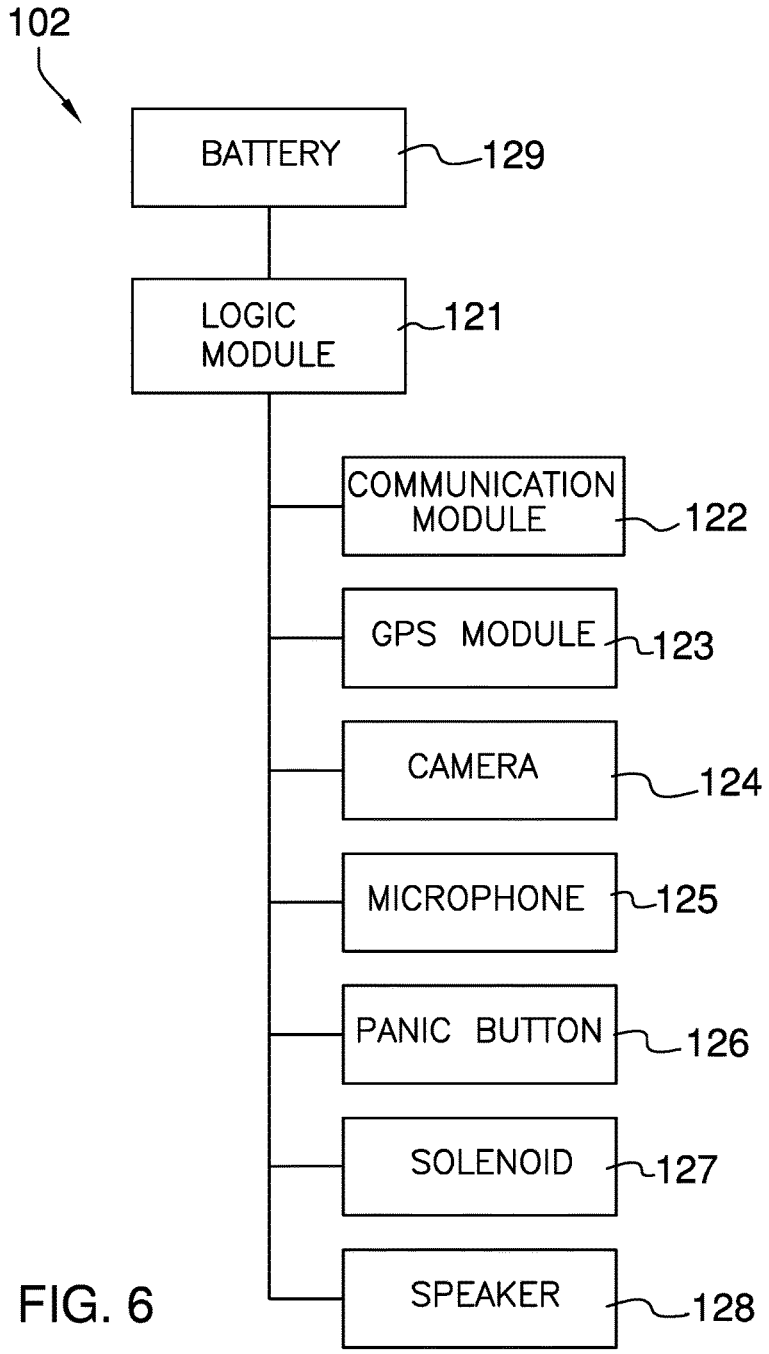
FIG. 6 is a block diagram of an embodiment of the disclosure.
Figure 7:
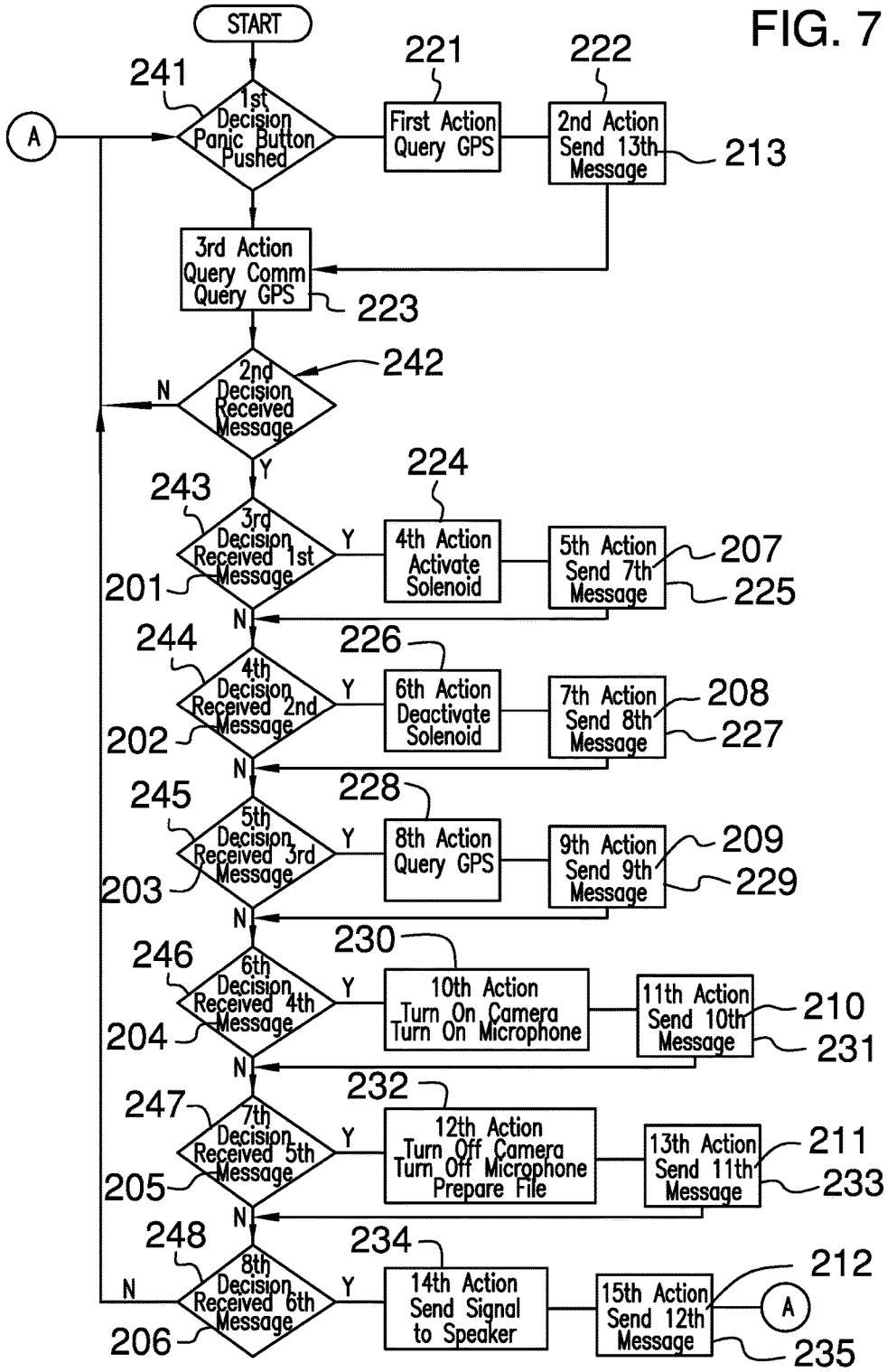
FIG. 7 is a flowchart of an embodiment of the disclosure.

As shown most clearly in FIG. 6, the control system 102 comprises a logic module 121, a communication module 122, a GPS module 123, a camera 124, a microphone 125, a panic button 126, a solenoid 127, a speaker 128, and a battery 129. The communication module 122, the GPS module 123, the camera 124, the microphone 125, the panic button 126, the solenoid 127, and the speaker 128 are electrically connected to the logic module 121. The battery 129 provides the electrical energy required to operate the control system 102.

The logic module 121 is a readily and commercially available programmable electronic device that is used to manage, regulate, and operate the control system 102. The GPS module 123 is a readily and commercially available electrical device that communicates with the GPS to determine the GPS coordinates of the GPS module 123. When queried by the logic module 121, the GPS module 123 transfers the GPS coordinates to the logic module 121. The communication module 122 is a readily and commercially available wireless electronic communication device that operates as a transceiver. The logic module 121 uses the communication module 122 to transmit messages to and to receive messages from the appropriate authority 141. In the first potential embodiment of the disclosure, the communication module 122 is an electronic device that communicates SMS and MMS messages through a commercially provided and publically available wireless network. The use of a commercially provided and publically available wireless network is preferred because: 1) of its low cost; 2) of its widespread availability and broad interoperability between competing publically available wireless networks; and, 3) methods and techniques to send SMS and MMS messages over a publically available wireless network are well known and documented by those skilled in the electrical arts.

The camera 124 is a commercially available sensor that installed in the housing 103 such that the camera 124 captures light from the exterior of the housing 103. The microphone 125 is a commercially available microphone that is installed in the housing 103 such that the microphone 125 captures audible sounds from the exterior of the housing 103. Methods and techniques to install cameras 124 and microphones 125 in housings 103 are well known and documented in the mechanical and manufacturing arts. Methods and techniques to process and store electronic signals from cameras 124 and microphones 125 using a logic module 121 are well known and documented in the electrical arts. The speaker 128 is a readily and commercially available transducer that converts an electrical signal from the logic module 121 into an audible sound. The speaker 128 mounts in the housing 103 such that audible sound from the speaker 128 has access to the exterior of the housing 103. The purpose of the speaker 128 is to allow the appropriate authority 141 to transmit an audible message to the individual through the invention 100. In the first potential embodiment of the disclosure, the speaker 128 is a buzzer.

The panic button 126 is a readily and commercially available single pole single throw normally open momentary switch that is monitored by the logic module 121. The logic module 121 takes the panic button 126 as a logical signal that causes the logic module 121 to transmit a thirteenth message 213 to the appropriate authority 141. The thirteenth message 213 is discussed in more detail elsewhere in this disclosure.

The solenoid 127 is a readily and commercially available electric device that is used as a detent to lock the latch tab 114 in the latch slot 112. The solenoid 127 comprises a shaft 130. As shown most clearly in FIG. 5, the solenoid 127 mounts in the housing 103 such that the shaft 130 of the solenoid 127 is extended into the hole 116 of the U shaped metal structure 115 when the solenoid 127 is activated. When the solenoid 127 is deactivated, the shaft 130 of the solenoid 127 is retracted. When the solenoid 127 is activated, the latch tab 114 is locked within the latch slot 112. The design of the solenoid 127, the latch slot 112, and the latch tab 114 is such that only the appropriate authority 141, through the exchange of messages with the control system 102, can lock or unlock the latch tab 114 within the latch slot 112. Worded another way, the design intention is such that the individual wearing the invention 100 is not able to remove the invention 100 from their person the knowledge or action of the appropriate authority 141. In the first potential embodiment of the disclosure, the selected solenoid 127 is marketed as a "micro push pull" solenoid and has a volume of less than 0.17 cubic inches.

The battery 129 is a commercially available battery 129 that is stored within the housing 103 and that provides electrical power for the operation of the control system 102. The battery 129 is either replaceable or rechargeable depending on the design. The use of batteries is well known and documented in the electrical arts.

Methods to design, implement and fabricate the control system 102 as described in this disclosure are well known and documented in the electrical arts.

The invention 100 is adapted for use by and with an appropriate authority 141 that has responsibility for monitoring and responding to the security needs of the individual wearing the invention 100. Within this context, it is assumed that the appropriate authority 141 can designate the responsibilities of the appropriate authority 141 to a surrogate electronic device under the supervision of the appropriate authority 141. Specifically, the exchange of messages between the invention 100 and the appropriate authorities 141 can be automated and delegated to one or more surrogate electronic devices including, but not limited to, personal data devices or commercially available internet services often referred to as "cloud" services.

The interactions between the control system 102 and the appropriate authority 141 is based on a plurality of messages that are exchanged between the control system 102 and the appropriate authority 141. Each of the plurality of messages is a predetermined message. In the first potential embodiment of the disclosure, each of the plurality of messages contains a header that further identifies: 1) the individual wearing the invention 100; 2) a secondary emergency contact for use by the appropriate authorities 141; and, 3) the last known GPS coordinates of the invention 100.

In the first potential embodiment of the disclosure, the plurality of messages comprises a first message 201, a second message 202, a third message 203, a fourth message 204, a fifth message 205, a sixth message 206, a seventh message 207, an eighth message 208, a ninth message 209, a tenth message 210, an eleventh message 211, a twelfth message 212, and a thirteenth message 213. The first message 201 is a message received by the logic module 121 from the appropriate authorities 141 through the communication module 122 indicating that a request to lock the band 113 has been received. The second message 202 is a message received by the logic module 121 from the appropriate authorities 141 through the communication module 122 indicating that a request to release the band 113 has been received. The third message 203 is a message received by the logic module 121 from the appropriate authorities 141 through the communication module 122 indicating that a location request has been received. The fourth message 204 is a message received by the logic module 121 from the appropriate authorities 141 through the communication module 122 indicating that a video and audio record request has been received. The fifth message 205 is a message received by the logic module 121 from the appropriate authorities 141 through the communication module 122 indicating that a request to stop video and audio recording and to send the file to the appropriate authority 141 has been received. The sixth message 206 is a message received by the logic module 121 from the appropriate authorities 141 through the communication module 122 indicating a request to generate a sound over the speaker 128.

The seventh message 207 is a message transmitted by the logic module 121 to the appropriate authorities 141 through the communication module 122 confirming that the band 113 has been locked. The eighth message 208 is a message transmitted by the logic module 121 to the appropriate authorities 141 through the communication module 122 confirming that the band 113 has been released. The ninth message 209 is a message transmitted by the logic module 121 to the appropriate authorities 141 through the communication module 122 providing the GPS coordinates of the invention 100. The tenth message 210 is a message transmitted by the logic module 121 to the appropriate authorities 141 through the communication module 122 confirming that the video and audio recording has commenced. The eleventh message 211 is a message transmitted by the logic module 121 to the appropriate authorities 141 through the communication module 122 uploading the file containing the video and audio recording for use by the appropriate authority 141. The twelfth message 212 is a message transmitted by the logic module 121 to the appropriate authorities 141 through the communication module 122 confirming that the sound has been generated over the speaker 128. The thirteenth message 213 is a message transmitted by the logic module 121 to the appropriate authorities 141 through the communication module 122 indicating that the wearer of the watch is requesting assistance and further providing the GPS location of the invention 100 to the appropriate authority 141.

The attention of this disclosure now moves to the operation of the invention 100.

The logic module 121 makes a first decision 241 to determine if the panic button 126 has been actuated. If the panic button 126 has been actuated, the logic module 121 takes a first action 221 of querying the GPS module 123 to determine the GPS coordinates of the invention 100. The logic module 121 follows this action by taking a second action 222 of sending the thirteenth message 213 through the communication module 122 to the appropriate authority 141. The logic module 121 then takes a third action 223. If the panic button 126 has not been actuated, the logic module 121 takes the third action 223.

The logic module 121 takes the third action 223 of querying the communication module 122 for received messages and querying the GPS module 123 to determine the GPS coordinates of the invention 100. The logic module 121 then makes a second decision 242 to determine if a message selected from the plurality of messages has been received via the communication module 122. If no message has been received via the communication module 122, then the logic module 121 loops back to the first decision 241.

If the communication module 122 has received a message selected from the plurality of messages then the logic module 121 makes a third decision 243 to determine if the first message 201 has been received by the communication module 122. If the first message 201 has been received then the logic module 121 takes a fourth action 224 of activating the solenoid 127 to lock the band 113 followed by a fifth action 225 of sending the seventh message 207 through the communication module 122 to the appropriate authority 141. The logic module 121 then proceeds to the fourth decision 244. If the first message 201 has not been received then the logic module 121 proceeds directly to the fourth decision 244.

The logic module 121 makes a fourth decision 244 to determine if the second message 202 has been received via the communication module 122. If the second message 202 has been received, then the logic module 121 takes a sixth action 226 of deactivating the solenoid 127 to unlock the band 113 followed by a seventh action 227 of sending the eighth message 208 through the communication module 122 to the appropriate authority 141. The logic module 121 then proceeds to the fifth decision 245. If the second message 202 has not been received, then the logic module 121 then proceeds directly to the fifth decision 245.

The logic module 121 makes a fifth decision 245 to determine if the third message 203 has been received via the communication module 122. If the third message 203 has been received, then the logic module 121 takes an eighth action 228 of querying the GPS module 123 to determine the GPS coordinates of the invention 100 followed by a ninth action 229 of sending the ninth message 209 through the communication module 122 to the appropriate authority 141. The logic module 121 then proceeds to the sixth decision 246. If the third message 203 has not been received then the logic module 121 then proceeds directly to the sixth decision 246.

The logic module 121 makes a sixth decision 246 to determine if the fourth message 204 has been received via the communication module 122. If the fourth message 204 has been received, then the logic module 121 takes a tenth action 230 of turning on the camera 124 turning on the microphone 125 and making a video recording of the activities around the invention 100 following by an eleventh action 231 of sending the tenth message 210 through the communication module 122 to the appropriate authority 141. The logic module 121 then proceeds to the seventh decision 247. If the fourth message 204 has not been received then the logic module 121 then proceeds directly to the seventh decision 247.

The logic module 121 makes a seventh decision 247 to determine if the fifth message 205 has been received via the communication module 122. If the fifth message 205 has been received, then the logic module 121 takes a twelfth action 232 of turning off the camera 124, turning off the microphone 125, and preparing a video file of the video recording for transmission to the appropriate authority 141 followed by a thirteenth action 233 of sending the eleventh message 211 through the communication module 122 to the appropriate authority 141. The logic module 121 then proceeds to the eighth decision 248. If the fifth message 205 has not been received then the logic module 121 then proceeds directly to the eighth decision 248.

The logic module 121 makes an eighth decision 248 to determine if the sixth message 206 has been received via the communication module 122. If the sixth message 206 has been received, then the logic module 121 takes a fourteenth action of sending an audible signal to the speaker 128 followed a fifteenth action 235 of sending the twelfth message 212 through the communication module 122 to the appropriate authority 141. The logic module 121 then loops back to the first decision 241. If the sixth message 206 has not been received, then the logic module 121 loops directly back to the first decision 241.

To use the invention 100, the band 113 is placed around the wrist of the individual such that the latch tab 114 is inserted into the latch slot 112. Using the surrogate electronic device, the appropriate authority 141 then transmits the first message 201 to the invention 100 to lock the invention 100 on the individual. The appropriate authority 141 then uses the surrogate electronic device to operate the invention 100 as needed. Using the surrogate electronic device, the appropriate authority 141 then transmits the second message 202 to the invention 100 to unlock the invention 100 from the individual.

The following definitions were used in this disclosure:

Accessory: As used in this disclosure, an accessory is an object that adds to the convenience or attractiveness of, but is not required for the use of, a basic clothing set.

Appropriate Authority: As used in this disclosure, an appropriate authority is person or organization that is designated to receive alarm or other notification messages from a monitored system or activity.

Band: As used in this disclosure, a band is a flat loop of material.

Battery: As used in this disclosure, a battery is a container consisting of one or more cells, in which chemical energy is converted into electricity and used as a source of power.

Buzzer: As used in this disclosure, a buzzer is two lead electrical device that generates an audible sound when voltage is applied to the two leads.

Camera: As used in this disclosure, a camera is a sensor that converts light into electric signals that encode and records the spatial orientation of the captured light in a manner that reproduces the images seen by a human eye.

Control System: As used in this disclosure, a control system is a first device or system that manages and regulates the behavior or operation of a second device or system.

Detent: As used in this disclosure, a detent is a device for attaching a first object to a second object in a detachable manner.

Exterior: As used in this disclosure, the exterior is use as a relational term that implies that an object is not contained within the boundary of a structure or a space.

GPS: As used in this disclosure, depending on the context GPS refers to: 1) a system of navigational satellites that are used to determine the position and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System.

Housing: As used in this disclosure, a housing is a rigid casing that encloses and protects one or more devices.

Interior: As used in this disclosure, the interior is use as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

Logic Module: As used in this disclosure, a logic module is an electrical device that is programmable and that accepts digital and analog inputs, processes the digital and analog inputs according to previously stored instruction and provides the results of these instructions as digital or analog outputs.

Microphone: As used in this disclosure, a microphone is a transducer that converts the energy from vibration into electrical energy. The sources of vibrations include, but are not limited to, acoustic energy.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. So for example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Personal Data Device: As used in this disclosure, a personal data device is a handheld device that is used for managing personal information and communication. Examples of personal data device include, but are not limited to, cellular phones, tablets and smart phones.

SMS: As used in this disclosure, SMS is an abbreviation for short message service. The short message service is a service that is often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Solenoid: As used in this disclosure, a solenoid is a cylindrical coil of electrical wire that generates a magnetic field that can be used to mechanically move a shaft made of a magnetic core.

Speaker: As used in this disclosure, a speaker is an electrical transducer that converts an electrical signal into an audible sound.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transceiver: As used in this disclosure, a transceiver is a device that is used to transmit and receive radio signals.

Transducer: As used in this disclosure, a transducer is a device that converts a physical quantity, such as pressure or brightness into an electrical signal or a device that converts an electrical signal into a physical quantity.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety device comprising:

a timepiece, a control system, and a housing;

wherein the timepiece and the control system mount within the housing;

wherein the safety device is a signaling device that is worn in a manner of an accessory;

wherein the safety device communicates with an appropriate authority in a message based manner;

wherein the safety device allows an appropriate authority can determine a location of the safety device and to monitor a exterior surroundings of the safety device;

wherein the safety device provides for a transmission of an emergency message;

wherein safeguards are incorporated into the safety device to prevent removal of the safety device without a approval or the appropriate authority;

wherein the housing comprises a container, a latch slot, a band, and a latch tab;

wherein the container is formed such that the timepiece is visibly accessible from the exterior of the housing;

wherein the container is further formed such that a panic button is physically accessible from the exterior of the housing;

wherein the band is a strap;

wherein the band further comprises the latch tab;

wherein the latch tab is a U shaped metal structure that has a hole formed therein;

wherein the latch slot is an aperture formed in the housing;

wherein the latch slot is sized to receive the U shaped metal structure;

wherein the latch tab inserts into the latch slot;

wherein the control system comprises a logic module, a communication module, a GPS module, a camera, a microphone, the panic button, a solenoid, a speaker, and a battery;

wherein the communication module, the GPS module, the camera, the microphone, the panic button, the solenoid, and the speaker are electrically connected to the logic module;

wherein the battery provides the electrical energy required to operate the control system;

wherein the logic module is a programmable electronic device that is used to manage, regulate, and operate the control system;

wherein the logic module makes a first decision to determine if the panic button has been actuated;

wherein the logic module takes a first action of querying the GPS module to determine a GPS coordinates of the safety device;

wherein takes a second action of sending a thirteenth message through the communication module to the appropriate authority;

wherein the logic module takes the third action of querying the communication module for received messages and querying the GPS module to determine the GPS coordinates of the safety device;

wherein the logic module makes a second decision to determine if a message has been received by the communication module;

wherein the logic module makes a third decision to determine if a first message has been received by the communication module;

wherein the logic module takes a fourth action of activating the solenoid;

wherein the logic module takes a fifth action of sending a seventh message through the communication module to the appropriate authority;

wherein the logic module makes a fourth decision to determine if a second message has been received by the communication module;

wherein the logic module takes a sixth action of deactivating the solenoid;

wherein the logic module takes a seventh action of sending an eighth message through the communication module to the appropriate authority;

wherein the logic module makes a fifth decision to determine if a third message has been received by the communication module;

wherein the logic module takes an eighth action of sending a ninth message through the communication module to the appropriate authority;

wherein the logic module makes a sixth decision to determine if a fourth message has been received by the communication module;

wherein the logic module takes a ninth action of turning on the camera, turning on the microphone, and making a video recording of the activities around the safety device;

wherein the logic module takes a tenth action of sending a tenth message through the communication module to the appropriate authority;

wherein the logic module makes a seventh decision to determine if a fifth message has been received by the communication module;

wherein the logic module takes a eleventh action of turning off the camera, turning off the microphone, and preparing a video file of the video recording for transmission to the appropriate authority;

wherein the logic module takes a twelfth action of sending an eleventh message through the communication module to the appropriate authority;

wherein the logic module makes an eighth decision to determine if a sixth message has been received by the communication module;

wherein the logic module takes a thirteenth action of sending an audible signal to the speaker;

wherein the logic module takes a fourteenth action of sending a twelfth message through the communication module to the appropriate authority.

2. The safety device according to claim 1 wherein the control system comprises a logic module, a communication module, a GPS module, a camera, a microphone, the panic button, a solenoid, a speaker, and a battery;

wherein the communication module, the GPS module, the camera, the microphone, the panic button, the solenoid, and the speaker are electrically connected to the logic module;

wherein the battery provides the electrical energy required to operate the control system;

wherein the logic module is a programmable electronic device that is used to manage, regulate, and operate the control system.

3. The safety device according to claim 2 wherein the GPS module is an electrical device;

wherein the GPS module communicates with the GPS to determine a GPS coordinates of the GPS module;

wherein the GPS module transfers the GPS coordinates to the logic module.

4. The safety device according to claim 3 wherein the communication module is a transceiver;

wherein the logic module uses the communication module to transmit messages to and to receive messages from the appropriate authority.

5. The safety device according to claim 4 wherein the communication module is an electronic device that communicates SMS and MMS messages through a commercially provided and publically available wireless network.

6. The safety device according to claim 5 wherein the camera is a sensor that installed in the housing such that the camera captures light from the exterior of the housing;

wherein the microphone is a microphone that is installed in the housing such that the microphone captures audible sounds from the exterior of the housing;

wherein the speaker is a transducer that converts an electrical signal from the logic module into an audible sound;

wherein the speaker mounts in the housing such that audible sound from the speaker has access to the exterior of the housing.

7. The safety device according to claim 6 wherein the solenoid is an electric device that is used as a detent to lock the latch tab in the latch slot.

8. The safety device according to claim 7 wherein the solenoid comprises a shaft;

wherein the solenoid mounts in the housing such that the shaft of the solenoid is extended into the hole of the U shaped metal structure when the solenoid is activated;

wherein when the solenoid is deactivated, the shaft of the solenoid is retracted.

9. The safety device according to claim 8 wherein the speaker is a buzzer;

wherein the panic button is a single pole single throw normally open momentary switch that is monitored by the logic module;

wherein the solenoid has a volume of less than 0.17 cubic inches.

10. The safety device according to claim 1 wherein the GPS module is an electrical device;

wherein the GPS module communicates with the GPS to determine the GPS coordinates of the GPS module;

wherein the GPS module transfers the GPS coordinates to the logic module;

wherein the communication module is a transceiver;

wherein the logic module uses the communication module to transmit messages to and to receive messages from the appropriate authority.

11. The safety device according to claim 10 wherein the camera is a sensor that installed in the housing such that the camera captures light from the exterior of the housing;

wherein the microphone is a microphone that is installed in the housing such that the microphone captures audible sounds from the exterior of the housing;

wherein the speaker is a transducer that converts an electrical signal from the logic module into an audible sound;

wherein the speaker mounts in the housing such that audible sound from the speaker has access to the exterior of the housing.

12. The safety device according to claim 11 wherein the solenoid is an electric device that is used as a detent to lock the latch tab in the latch slot;

wherein the solenoid comprises a shaft;

wherein the solenoid mounts in the housing such that the shaft of the solenoid is extended into the hole of the U shaped metal structure when the solenoid is activated;

wherein when the solenoid is deactivated, the shaft of the solenoid is retracted.

13. The safety device according to claim 12 wherein the communication module is an electronic device that communicates SMS and MMS messages through a commercially provided and publically available wireless network;

wherein the speaker is a buzzer;

wherein the panic button is a single pole single throw normally open momentary switch that is monitored by the logic module;

wherein the solenoid has a volume of less than 0.17 cubic inches.

14. The safety device according to claim 1 wherein the GPS module is an electrical device;

wherein the GPS module communicates with the GPS to determine the GPS coordinates of the GPS module;

wherein the GPS module transfers the GPS coordinates to the logic module;

wherein the communication module is a transceiver;

wherein the logic module uses the communication module to transmit messages to and to receive messages from the appropriate authority.

15. The safety device according to claim 14 wherein the camera is a sensor that installed in the housing such that the camera captures light from the exterior of the housing;

wherein the microphone is a microphone that is installed in the housing such that the microphone captures audible sounds from the exterior of the housing;

wherein the speaker is a transducer that converts an electrical signal from the logic module into an audible sound;

wherein the speaker mounts in the housing such that audible sound from the speaker has access to the exterior of the housing.

16. The safety device according to claim 15 wherein the solenoid is an electric device that is used as a detent to lock the latch tab in the latch slot;

wherein the solenoid comprises a shaft;

wherein the solenoid mounts in the housing such that the shaft of the solenoid is extended into the hole of the U shaped metal structure when the solenoid is activated;

wherein when the solenoid is deactivated, the shaft of the solenoid is retracted.

17. The safety device according to claim 16 wherein the communication module is an electronic device that communicates SMS and MMS messages through a commercially provided and publically available wireless network;

wherein the speaker is a buzzer;

wherein the panic button is a single pole single throw normally open momentary switch that is monitored by the logic module;

wherein the solenoid has a volume of less than 0.17 cubic inches.

* * * * *